US006310435B1

(12) United States Patent
Hageluken et al.

(10) Patent No.: US 6,310,435 B1
(45) Date of Patent: Oct. 30, 2001

(54) CATHODE RAY TUBE WITH GETTER ASSEMBLY

(75) Inventors: Ben Heinz Hageluken, Eindhoven (NL); João Gonçalves De Oliveira, Jr., São Jose Dos Campos (BR)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/497,004

(22) Filed: Feb. 2, 2000

(30) Foreign Application Priority Data

Feb. 12, 1999 (EP) ..... 99200405

(51) Int. Cl.[7] ..... H01J 31/00
(52) U.S. Cl. ..... 313/481; 313/482; 313/477 HC
(58) Field of Search ..... 313/481, 482, 313/477 HC, 404, 405, 406, 407

(56) References Cited

U.S. PATENT DOCUMENTS 4,182,974 1/1980 Van Ijzeren ..... 313/481

FOREIGN PATENT DOCUMENTS 7726914 2/1978 (DE) ..... H01J/29/94

OTHER PUBLICATIONS

"Cathode–Ray Tube", Japanese Abstract 1–124942(A) dated May 17, 1989.

"Cathode–Ray Tube", Japanese Abstract 60–221940(A) dated Nov. 6, 1985.

"Getter Holding and Fixing Mechanism for Cathode Ray Tube", Japanese Abstract 5–41188(A) dated Feb. 19, 1993.

"Getter Supporting/Fixing Method for Picture Tube", Japanese Abstract 2–86034(A), dated Mar. 27, 1990.

*Primary Examiner*—Alan Cariaso
*Assistant Examiner*—Hargobind S. Sawhney

(57) ABSTRACT

A cathode ray tube, which has a getter assembly (18) for providing proper vacuum conditions within the tube. The getter assembly (18) comprises a resilient strip (19) having a first end portion (23) and a second end portion (25), and is detachably secured to a high voltage contact (15). A getter cup (21) is connected to the first end portion (23). The second end portion (25) is cooperatively engaged with one, preferably two protrusions (30) for limiting lateral movements of the resilient strip (19). The protrusions (30) are provided inside the envelope (5) of the tube. This arrangement reduces the risk of obtaining a layer of getter material at the wrong location within the tube.

4 Claims, 1 Drawing Sheet

CATHODE RAY TUBE WITH GETTER ASSEMBLY

BACKGROUND OF THE INVENTION

The invention relates to a cathode ray tube comprising an envelope having a conical portion, a high-voltage contact, a resilient strip having a longitudinal direction and first and second end portions which are detachably secured to the high-voltage contact inside the envelope, the first end portion comprising a getter cup, said envelope having at least one protrusion on its internal side.

A cathode ray tube having a protrusion on the internal side of its envelope is disclosed in DE-U 7726914. The cathode ray tube according to the prior art comprises a high-voltage contact to which a resilient strip is detachably secured. A cup, which contains a getter material, is mounted at one end of the resilient strip. In a certain phase of the manufacturing process of the cathode ray tube, the resilient strip is secured to the anode contact. At a later stage, the getter material is heated, which causes the getter material to evaporate. Finally, after cooling, the tube is internally covered with a thin layer of getter material ensuring that proper vacuum conditions are maintained within the tube.

The resilient strip is detachably secured to the anode contact and may rotate freely around the high-voltage contact. If no precautions are taken, there will be a risk that the resilient strip might become rotated with respect to its initial position during further processing. Then, the dispositioned resilient strip with the getter cup might cause a getter layer at the wrong location within the tube or might result in non-uniformity of the deposited getter layer. Consequently, the vacuum conditions within the tube may not meet the quality requirements, which will lead to scrap. In order to prevent dispositioning, the envelope of the cathode ray tube according to the prior art internally comprises a protrusion near the getter cup. A resilient metal w-shaped element, which engages the protrusion, is mounted on the getter cap. The getter engagement according to the prior art has the disadvantage that the specific location of the protrusion near the getter cup may affect the quality and uniformity of the layer.

SUMMARY OF THE INVENTION

It is an object of the invention to provide a cathode ray tube in which the above disadvantages are reduced.

The cathode ray tube according to the invention is characterized in that the second end portion is cooperatively engaged with the protrusion for limiting lateral movements of the resilient strip. Such a cathode ray tube has the advantage that the risk of displacement of the getter cup and the resilient strip during further processing is reduced.

An embodiment of a cathode ray tube according to the invention is characterized in that the second end portion of the resilient strip is positioned between at least two protrusions. This embodiment will further reduce the risk that the resilient strip will be displaced. In addition, this embodiment allows the correct positioning of the resilient strip, when attached to the high-voltage contact.

A preferred form of a cathode ray tube according to the invention is characterized in that the protrusion has an elongated shape which extends substantially parallel to the longitudinal direction of the resilient strip. This elongated shape allows a good alignment of the getter assembly during attachment to the high-voltage contact.

A preferred form of a cathode ray tube according to the invention is characterized in that the distance, measured in the longitudinal direction between the center of the high-voltage contact and a point halfway the protrusion, is in the range between 2.5 and 3 cm. In practice, good vacuum conditions were obtained when said distance was within the indicated range.

These and other aspects of the invention will be elucidated with reference to the embodiments described hereinafter.

DETAILED DESCRIPTION OF THE PREFERRED EMBODIMENT

Figure 1:
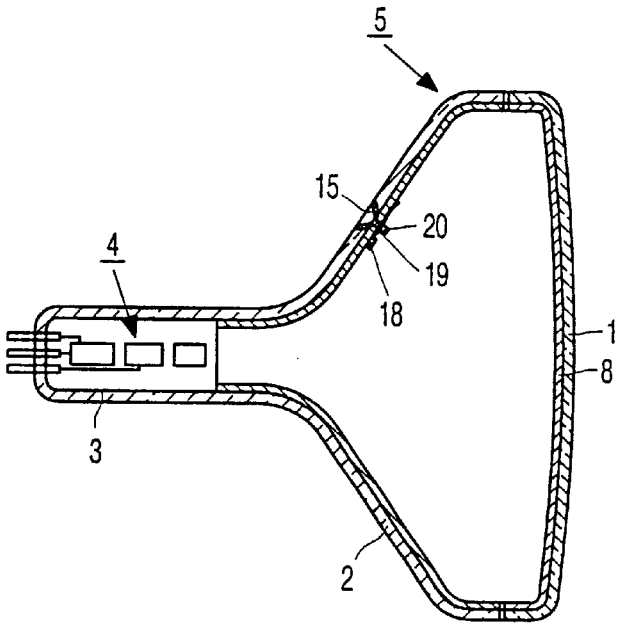
FIG. 1 is a sectional view of a color cathode ray tube according to the invention.

The cathode ray tube shown in FIG. 1 comprises a glass envelope 5 having a display window 1, a cone 2 and a neck 3. An electrode system 4 for generating electron beams is mounted in the neck 3. The electron beams are directed onto a screen 8 provided internally on the display window 1 and having a large number of phosphor strips.

As is known, after evacuation of the tube, a layer of getter material of, for example barium, strontium, calcium or magnesium is deposited on the tube wall so as to getter the residual gases left in the tube. As is shown in FIG. 1, according to the invention, a getter assembly 18 is mounted in the tube by means of a resilient strip 19 at a location remote from the electrode system 4. The getter assembly 18 is detachably secured to a high-voltage contact 15 by using a mounting arrangement described hereinafter with reference to FIGS. 2 and 3. These Figures show the wall portion of the cone 2 in which the high-voltage contact 15 is sealed. The high-voltage contact 15 has a connection member 16, which extends into the tube cavity and to which the getter assembly 18 is detachably connected.

The resilient strip 19 has a first end portion 23 and a second end portion 25. A getter cup 21 is connected to the first end portion 23. The getter cup 21 comprises getter material 22. The internal side of the envelope 5 is provided with at least one protrusion 30. In the cathode ray tube according to a preferred embodiment of the invention, the second end portion 25 is positioned between at least two protrusions 30. This embodiment correctly positions the resilient strip 19 during attachment to the connection member 16 and additionally prevents any possible displacement of the resilient strip 19 during further processing. A further advantageous embodiment may be realized with one protrusion that engages the second end portion 25, for example, by means of a hole or a U-shaped profile provided in the resilient strip 19.

Figure 2:
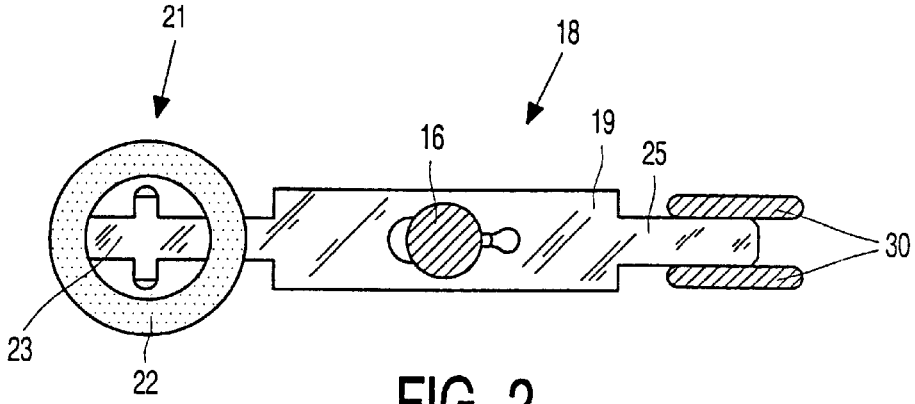
FIG. 2 is a plan view of an arrangement of a resilient strip and getter cup positioned between the two protrusions according to the invention.
Figure 3:
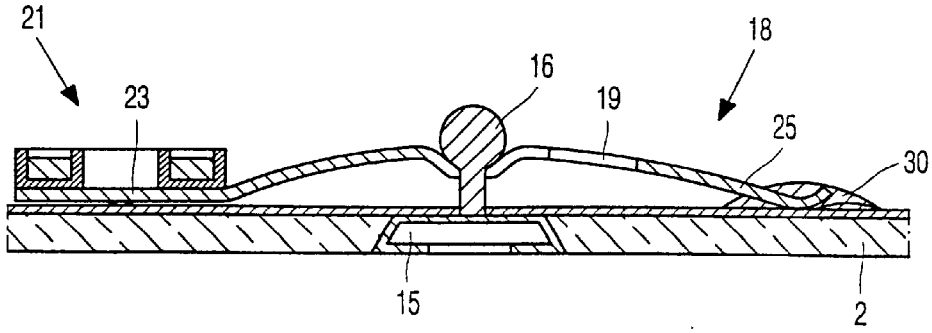
FIG. 3 is a sectional view of an arrangement of a resilient strip and getter cup positioned between the two protrusions according to the invention.

Preferably, the protrusions 30 may have an elongated shape, which extends substantially parallel to the longitudinal direction of the resilient strip 19 (from left to right in FIGS. 2 and 3). In practice, good results were obtained when the distance, measured in the longitudinal direction of the resilient strip between the center of the high-voltage contact and a point substantially halfway the protrusion, is in the range between 2.5 and 3 cm.

To test the positioning stability of the getter assembly 18 and the quality of the resulting getter layer, trials were made with batches of cathode ray tubes according to the invention. A first trial was made with cathode ray tubes subjected to ultrasonic vibrations. It appeared that no displacement of the getter assembly 18 occurred. Another trial was performed, which related to the quality of the getter layer. After the processing of the tubes, the tubes were subjected to high-voltage tests. Finally, the tubes were disassembled and the getter layer was analyzed. It was found that no high-tension problems occurred, and that a good adhesion and a good uniformity of the getter layer were realized.

In summary, the invention relates to a cathode ray tube which has a getter assembly 18 for providing proper vacuum conditions within the tube. The getter assembly 18 comprises a resilient strip 19 having a first end portion 23 and a second portion 25, and is detachably secured to a high-voltage contact 15. A getter cup 21 is connected to the first end portion 23. The second end portion 25 is cooperatively engaged with one, preferably two protrusions 30 for limiting lateral movements of the resilient strip 19. The protrusions 30 are provided inside the envelope 5 of the tube. This arrangement reduces the risk of obtaining a layer of getter material at the wrong location within the tube.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements.

We claim:

1. A cathode ray tube comprising an envelope (5) having a conical portion (2), a high-voltage contact (15), a resilient strip (19) having a longitudinal direction and having first (23) and second (25) end portions which are detachably secured to the high-voltage contact (15) inside the envelope (5), the first end portion (23) comprising a getter cup (21), said envelope (5) having at least one protrusion (30) on its internal side, characterized in that the second end portion (25) is cooperatively engaged with the protrusion (30) for limiting lateral movements of the resilient strip (19).

2. A cathode ray tube as claimed in claim 1, characterized in that the second end portion (25) of the resilient strip (19) is positioned between at least two protrusions (30).

3. A cathode ray tube as claimed in claim 2, characterized in that the protrusion (30) has an elongated shape which extends substantially parallel to the longitudinal direction of the resilient strip (19).

4. A cathode ray tube as claimed in claim 3, characterized in that the distance, measured in the longitudinal direction of the resilient strip (19) between the center of the high-voltage contact (15) and a point substantially halfway the protrusion (30), is in the range between 2.5 and 3 cm.

* * * * *